US006752046B1

(12) United States Patent
Lee

(10) Patent No.: US 6,752,046 B1
(45) Date of Patent: Jun. 22, 2004

(54) RATCHET WRENCH HAVING A POSITIONING STRUCTURE

(76) Inventor: Yi Min Lee, No. 62, Renmei Rd., Dali City, Taichung (TW), 412

( * ) Notice: Subject to any disclaimer, the term of this patent is extended or adjusted under 35 U.S.C. 154(b) by 1 day.

(21) Appl. No.: 10/335,817

(22) Filed: Jan. 3, 2003

(51) Int. Cl.[7] ..... B25B 13/46; B25B 23/16

(52) U.S. Cl. ..... 81/60; 83/62; 83/63.1; 83/177.85

(58) Field of Search ..... 81/60, 63, 63.1, 81/63.2, 62, 177.85

(56) References Cited

U.S. PATENT DOCUMENTS 3,924,493 A * 12/1975 Penner ..... 81/177.85
4,292,863 A * 10/1981 Hickman ..... 81/184
4,528,875 A * 7/1985 Hurst et al. ..... 81/185
4,602,534 A * 7/1986 Moetteli ..... 81/177.85
4,627,761 A * 12/1986 Olson et al. ..... 403/324
4,669,029 A * 5/1987 Svenson et al. ..... 361/728
4,817,475 A * 4/1989 Kelly et al. ..... 81/121.1
5,501,125 A * 3/1996 Roberts et al. ..... 81/177.85
5,503,048 A * 4/1996 Moon ..... 81/177.85

* cited by examiner

*Primary Examiner*—M. Rachuba
(74) *Attorney, Agent, or Firm*—Rosenberg, Klein & Lee

(57) ABSTRACT

A ratchet wrench having a positioning structure includes a wrench body, a cover mounted on the driving head of the wrench body, an elastic plate mounted between the driving head and the cover, and a push plate mounted between the driving head and the cover. The push plate is formed with an arcuate portion having an outer side rested on the elastic plate and an inner side extended into the opening of the cover. Thus, by combination of the elastic plate and the push plate, the socket is combined with the driving head integrally without detachment, thereby facilitating the user operating the ratchet wrench and the socket. In addition, the socket is detached from the driving head easily and conveniently.

6 Claims, 4 Drawing Sheets

RATCHET WRENCH HAVING A POSITIONING STRUCTURE

BACKGROUND OF THE INVENTION

1. Field of the Invention

The present invention relates to a ratchet wrench having a positioning structure, and more particularly to a ratchet wrench having a positioning structure, wherein by combination of the elastic plate and the push plate, the socket is combined with the driving head of the wrench body integrally without detachment, thereby facilitating the user operating the ratchet wrench and the socket.

2. Description of the Related Art

A conventional ratchet wrench in accordance with the prior art comprises a wrench body having a driving head, and a socket mounted in the driving head of the wrench body. Thus, the socket is used to rotate a workpiece, such as a nut or a bolt, by rotation of the driving head of the wrench body. However, the socket is not mounted in the driving head of the wrench body rigidly and stably, so that the socket is easily detached from the driving head of the wrench body during operation, thereby causing inconvenience to the user in operating the conventional ratchet wrench.

SUMMARY OF THE INVENTION

The present invention has arisen to mitigate and/or obviate the disadvantage of the conventional ratchet wrench.

The primary objective of the present invention is to provide a ratchet wrench having a positioning structure, wherein by combination of the elastic plate and the push plate, the socket is combined with the driving head of the wrench body integrally without detachment, thereby facilitating the user operating the ratchet wrench and the socket.

Another objective of the present invention is to provide a ratchet wrench having a positioning structure, wherein the socket is detached from the driving head of the wrench body easily and conveniently.

A further objective of the present invention is to provide a ratchet wrench having a positioning structure, wherein the socket is retained by the push plate, so that the socket is not detached from the driving head of the wrench body during rotation of the driving head of the wrench body, thereby facilitating the user operating the ratchet wrench and the socket to rotate a workpiece.

A further objective of the present invention is to provide a ratchet wrench having a positioning structure wherein the socket is mounted on and detached from the driving head of the wrench body rapidly, easily and conveniently.

In accordance with the present invention, there is provided a ratchet wrench having a positioning structure, comprising:

- a wrench body including a driving head;
- a cover mounted on the driving head of the wrench body and having a center formed with an opening;
- an elastic plate mounted between the driving head of the wrench body and the cover; and
- a push plate mounted between the driving head of the wrench body and the cover, the push plate having a first end formed with an arcuate portion, the arcuate portion of the push plate having an outer side rested on the elastic plate and an inner side extended into the opening of the cover.

Further benefits and advantages of the present invention will become apparent after a careful reading of the detailed description with appropriate reference to the accompanying drawings.

DETAILED DESCRIPTION OF THE INVENTION

Figure 1:
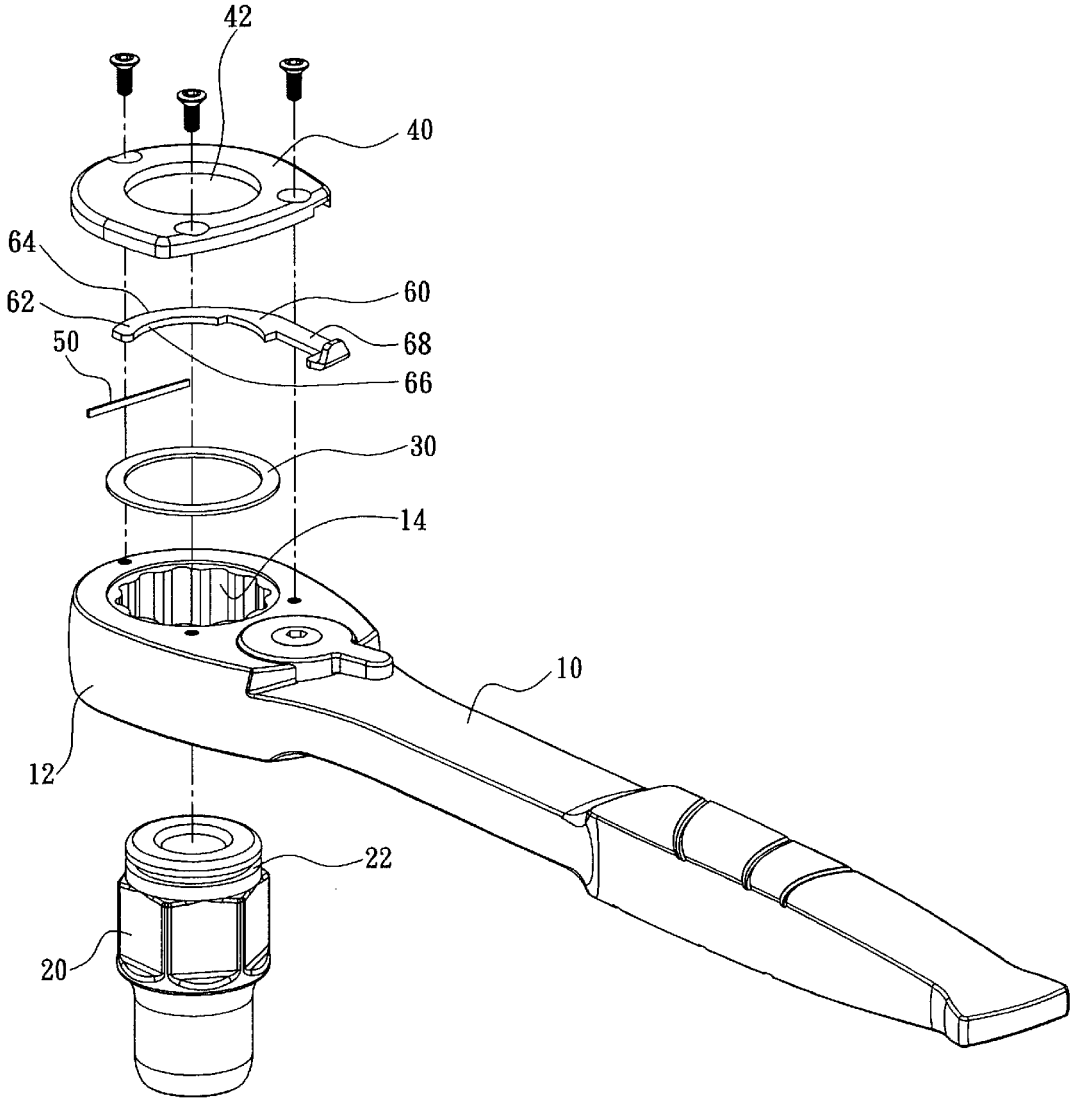
FIG. 1 is an exploded perspective view of a ratchet wrench having a positioning structure in accordance with a preferred embodiment of the present invention.
Figure 2:
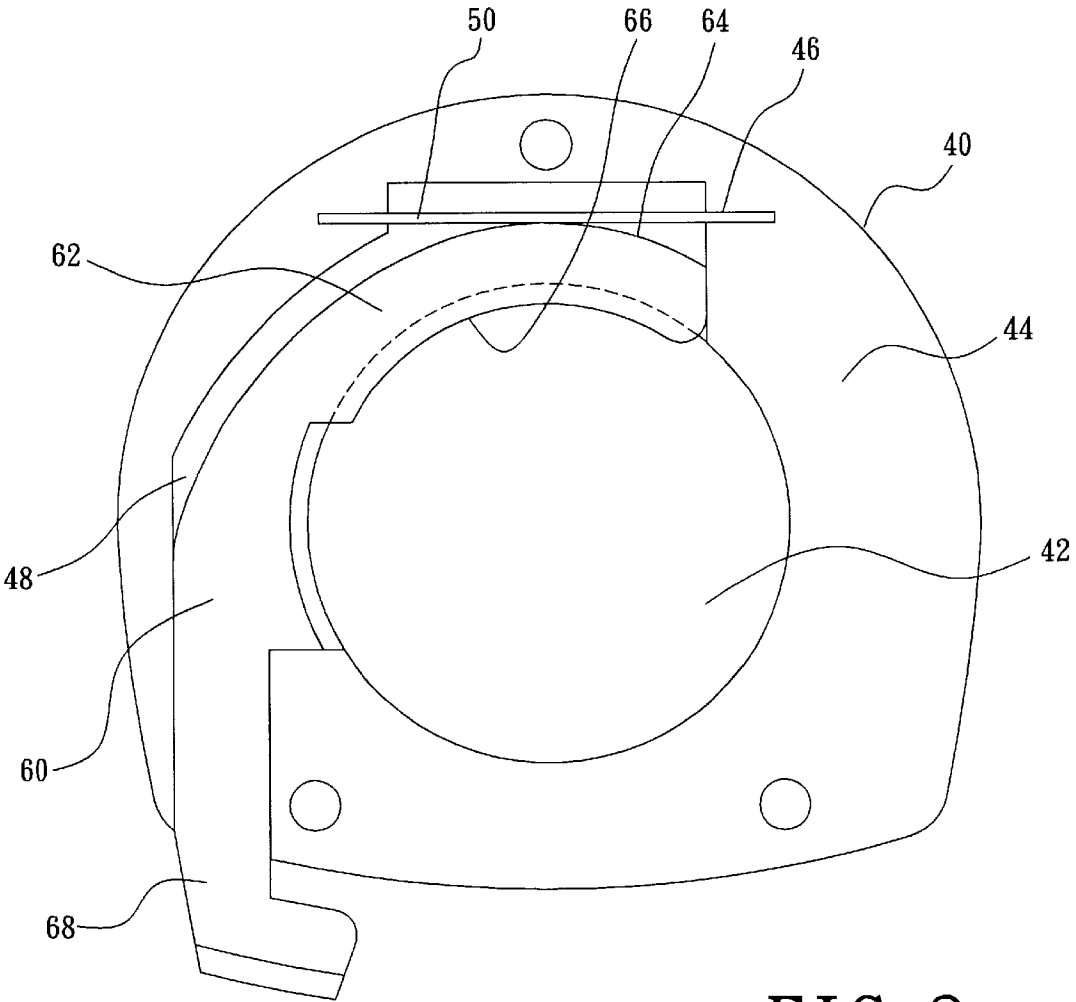
FIG. 2 is a partially bottom plan assembly view of the ratchet wrench having a positioning structure as shown in FIG. 1.
Figure 3:
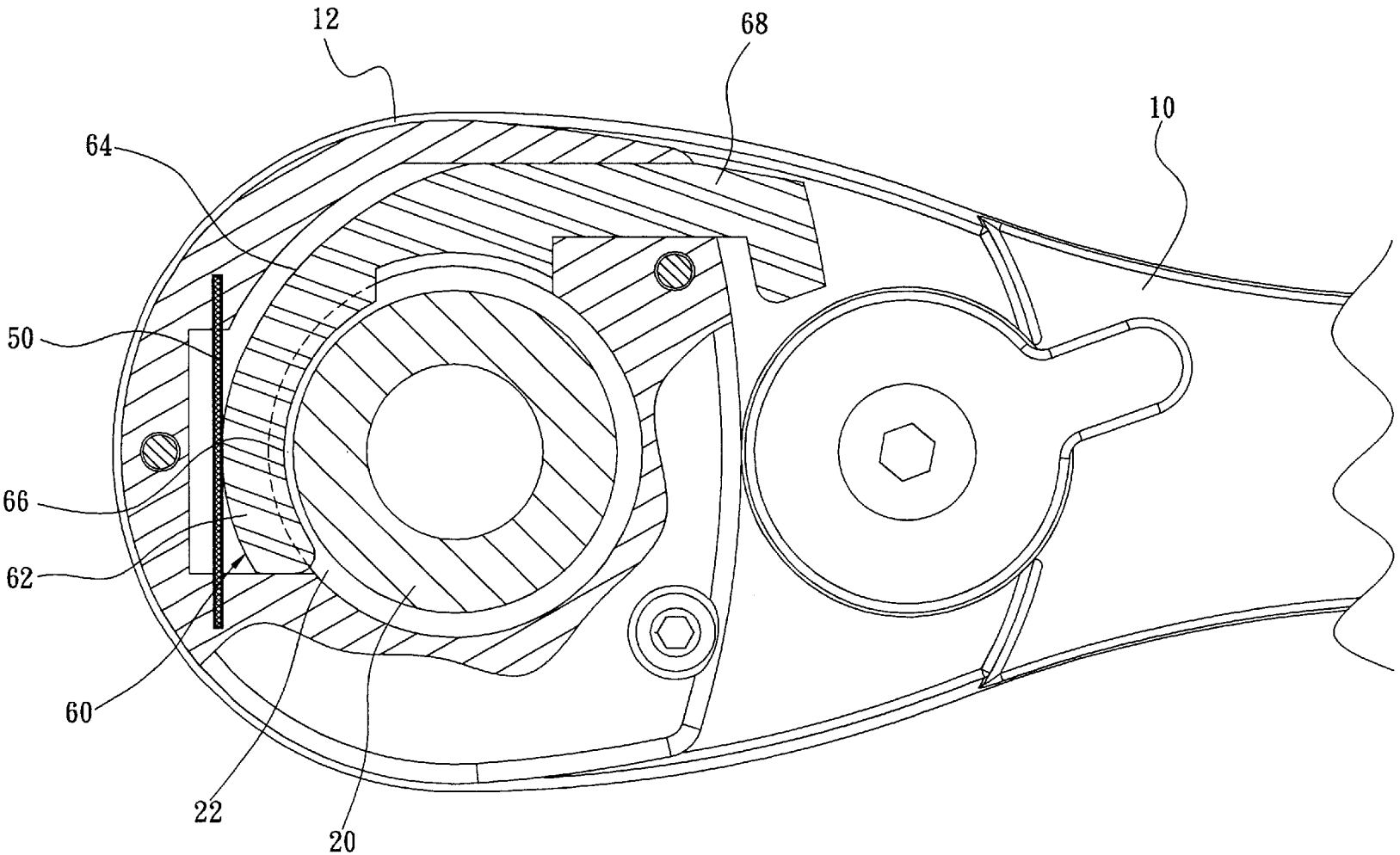
FIG. 3 is a partially cut-away top plan assembly view of the ratchet wrench having a positioning structure as shown in FIG. 1

Referring to the drawings and initially to FIGS. 1–3, a ratchet wrench having a positioning structure in accordance with a preferred embodiment of the present invention comprises a wrench body 10 a socket 20, a washer 30, a cover 40, an elastic plate 50, and a push plate 60.

The wrench body 10 includes a driving head 12 and a ratchet wheel 14 mounted in the driving head 12.

The socket 20 is mounted in the ratchet wheel 14 and has a top formed with an annular groove 22.

The washer 30 is ring-shaped and is mounted on a surface of the driving head 12 of the wrench body 10.

The cover 40 is mounted on the surface of the driving head 12 of the wrench body 10 and has a center formed with an opening 42. The cover 40 has a bottom face 44 formed with a strip-shaped insertion groove 46 and an arcuate mounting recess 48.

The elastic plate 50 is mounted in the insertion groove 46 of the cover 40 and is mounted on the surface of the driving head 12 of the wrench body 10.

The push plate 60 is mounted in the mounting recess 48 of the cover 40 and is mounted on the surface of the driving head 12 of the wrench body 10. The push plate 60 has a first end formed with an arcuate portion 62. The arcuate portion 62 oft he push plate 60 has an outer side 64 rested on the elastic plate 50 and an inner side 66 extended into the opening 42 of the cover 40. The push plate 60 has a second end formed with a push portion 68 protruding outward from the cover 40.

As shown in FIG. 3, the socket 20 is mounted in the ratchet wheel 14 in the driving head 12 of the wrench body 10. At this time, the arcuate portion 62 of the push plate 60 is pushed by the elastic plate 50, so that the inner side 66 of the arcuate portion 62 of the push plate 60 is inserted into and locked in the annular groove 22 of the socket 20, thereby combining the socket 20 with the driving head 12 of the wrench body 10 integrally without detachment. Thus, the socket 20 is retained by the push plate 60, so that the socket 20 is not detached from the driving head 12 of the wrench body 10 during rotation of the driving head 12 of the wrench body 10. Thereby facilitating the user operating the ratchet wrench and the socket 20 to rotate a workpiece (not shown).

Figure 4:
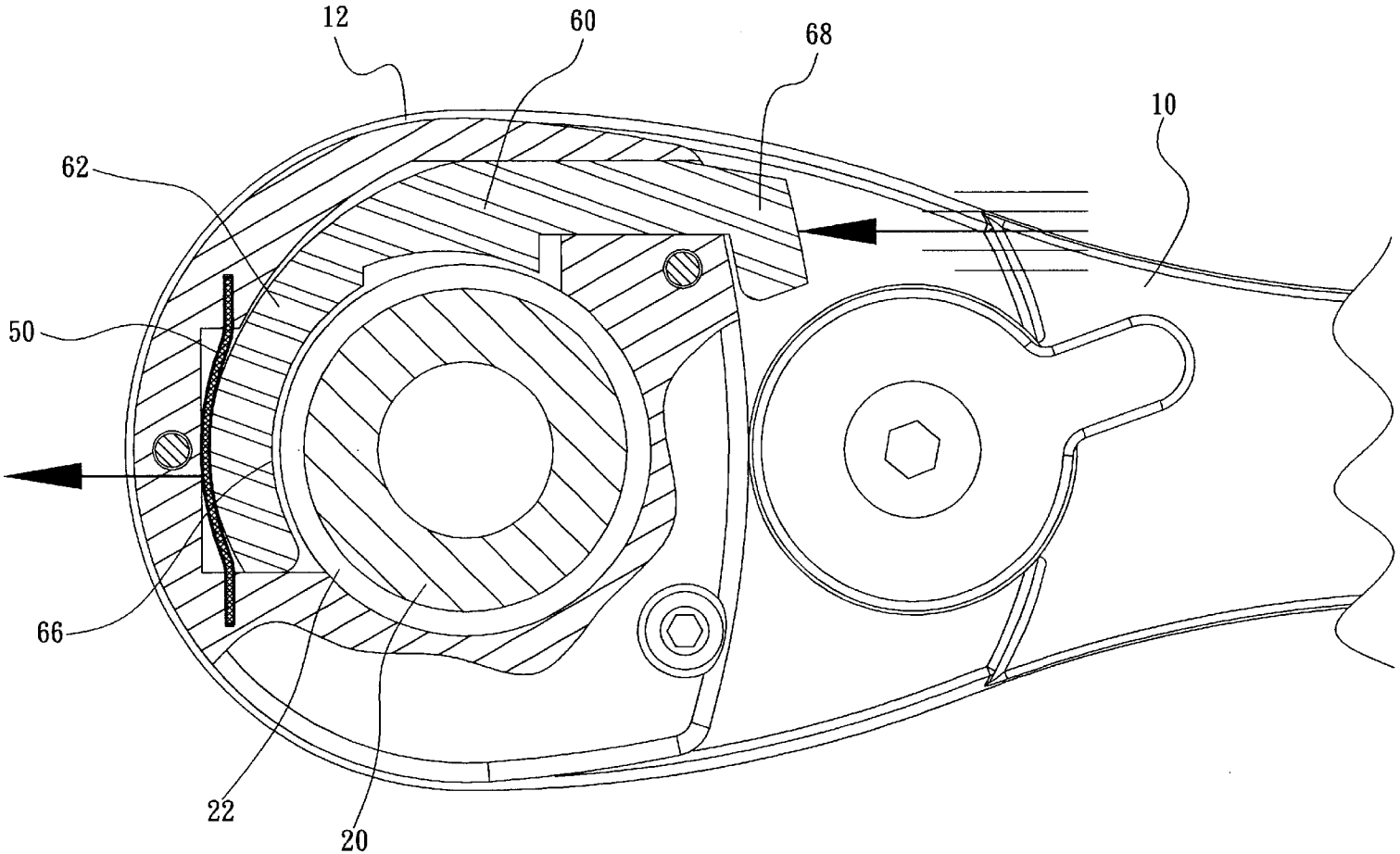
FIG. 4 is a schematic operational view of the ratchet wrench having a positioning structure as shown in FIG. 3 in detachment.

As shown in FIG. 4, the user only needs to exert a force to push the push portion 68 of the push plate 60 to move toward the elastic plate 50. At this time, the push plate 60 is pushed and moved from the position as shown in FIG. 3 to the position as shown in FIG. 4. In such a manner, the outer side 64 of the arcuate portion 62 of the push plate 60 is urged on the elastic plate 50 to bend and deform the elastic plate

50. After the elastic plate 50 is deformed, the push plate 60 is displaced to the position as shown in FIG. 4, so that the inner side 66 of the arcuate portion 62 of the push plate 60 is detached from the annular groove 22 of the socket 20, thereby detaching the socket 20 from the driving head 12 of the wrench body 10. Thus, the socket 20 is detached from the driving head 12 oft he wrench body 10 easily and conveniently.

Accordingly, by combination of the elastic plate 50 and the push plate 60, the socket 20 is combined with the driving head 12 of the wrench body 10 integrally without detachment, thereby facilitating the user operating the ratchet wrench and the socket 20. In addition, the socket 20 is detached from the driving head 12 of the wrench body 10 easily and conveniently.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A ratchet wrench having a positioning structure, comprising:

a wrench body including a driving head;

a cover mounted on the driving head of the wrench body and having a center formed with an opening;

an elastic plate mounted between the driving head of the wrench body and the cover; and a push plate mounted between the driving head of the wrench body and the cover, the push plate having a first end formed with an arcuate portion, the arcuate portion of the push plate having an outer side rested on the elastic plate and an inner side extended into the opening of the cover.

2. The ratchet wrench having a positioning structure in accordance with claim 1, wherein the cover has a bottom face formed with a strip-shaped insertion groove, and the elastic plate is mounted in the insertion groove of the cover.

3. The ratchet wrench having a positioning structure in accordance with claim 1, wherein the cover has a bottom face formed with an arcuate mounting recess, and the push plate is mounted in the mounting recess of the cover.

4. The ratchet wrench having a positioning structure in accordance with claim 1, wherein the push plate has a second end formed with a push portion protruding outward from the cover.

5. The ratchet wrench having a positioning structure in accordance with claim 1, further comprising a ring-shaped washer mounted between the driving head of the wrench body and the cover.

6. The ratchet wrench having a positioning structure in accordance with claim 1, further comprising a socket, mounted in the ratchet wheel and having a top formed with an annular groove, wherein the arcuate portion of the push plate is pushed by the elastic plate, and the inner side of the arcuate portion of the push plate is inserted into and locked in the annular groove of the socket, thereby combining the socket with the driving head of the wrench body integrally.

* * * * *